United States Patent [19]

Steinbach

[11] 4,069,696

[45] Jan. 24, 1978

[54] AXIAL SPLIT-PIN TUMBLER-TYPE LOCK AND KEY THEREFOR

[75] Inventor: Robert L. Steinbach, Chicago, Ill.

[73] Assignee: Chicago Lock Co., Chicago, Ill.

[21] Appl. No.: 716,157

[22] Filed: Aug. 20, 1976

[51] Int. Cl.[2] ..... E05B 27/08

[52] U.S. Cl. ..... 70/363; 70/386; 70/404

[58] Field of Search ..... 70/363, 404, 386, 407, 70/401, 403

[56] References Cited

U.S. PATENT DOCUMENTS

| | | | |
|---|---|---|---|
| 3,509,748 | 5/1970 | Trainer | 70/363 |
| 3,744,286 | 7/1973 | Trainer | 70/404 |
| 3,813,906 | 6/1974 | Kerr | 70/363 |
| 3,903,720 | 9/1975 | Scherbing | 70/363 |
| 3,961,507 | 6/1976 | Falk | 70/363 |

FOREIGN PATENT DOCUMENTS

| | | | |
|---|---|---|---|
| 534,215 | 1/1922 | France | 70/363 |

*Primary Examiner*—Robert L. Wolfe
*Attorney, Agent, or Firm*—Norman H. Gerlach

[57] ABSTRACT

A lock and key combination includes an axial split-pin tumbler-type lock having a lock cylinder and a barrel assembly secured within the cylinder. The barrel assembly includes a forwardly disposed rotatable operating part and a rearwardly disposed stationary part, which carry in longitudinal bores thereof spring-pressed tumblers having separate driver and follower elements, the driver elements of which extend forwardly out of the bores for engagement with the key. The operating part has a planar front face surrounding a forwardly extending key guide post adapted to resist application of lock-picking torque. The key has a shank provided with a socket adapted for receiving the guide post therein. Bittings on the outer periphery of the shank are adapted for engagement with the front ends of the driver elements to hold the tumblers in positions wherein a transverse interfacial plane between the operating and stationary parts coincides with the joints between the driver and follower elements to free the operating part for rotation. A drive tooth on the outer periphery of the key shank is adapted for sidewise engagement alternately with two of the driver elements, for driving the operating part alternately in opposite directions when the key is turned in such directions.

14 Claims, 14 Drawing Figures

AXIAL SPLIT-PIN TUMBLER-TYPE LOCK AND KEY THEREFOR

BACKGROUND OF THE INVENTION

This invention relates to an axial split-pin tumbler-type lock, more particularly, a tamper-resistant lock, and a key therefor.

Heretofore, various locks of the axial split-pin tumbler-type have been devised, having means designed to render them tamper- or pick-resistant. Also, lock keys have been designed together with their locks to render the keys difficult to duplicate. The prior locks and keys have achieved varying degrees of success in preventing or forestalling the opening of the locks by unauthorized persons. Generally speaking, it is possible ultimately to pick any key-operated lock, and efforts to prevent unauthorized picking are based on rendering the operation difficult and time-consuming, and also, making it difficult to design a successful pick. In some instances, duplication of keys has been restricted by key designs that are not readily reproduced with conventional equipment, such as used by locksmiths, but, instead, require specialized equipment.

Locks and keys designed to achieve the foregoing objectives are disclosed in U.S. Pat. Nos. 3,267,706, 3,320,783 and 3,813,906. While very useful, the lock and key combinations of these patents, in common with other prior structures, have a rotatable operating part which is constructed so that it lends itself to engagement by a picking tool, in such a manner that torque may be applied to the operating part while the tumblers are being probed.

SUMMARY OF THE INVENTION

The present invention represents an improvement over the prior structures, such as disclosed in the above-identified patents. In particular, the structure of the present invention eliminates the torqueing point for a picking tool which is found in the prior lock structures, thereby resisting picking by the means and methods previously employed to open locks of the present type. A novel key structure is provided, which serves to drive the operating part of the lock in a unique manner and thereby complements the pick-resistant design of the lock. Other structural features and advantages of the lock and key are described hereinafter.

In the axial split-pin tumbler-type lock and key combination of the invention, the lock includes a lock cylinder, a barrel assembly secured within the cylinder and having a longitudinal axis extending between front and rear ends thereof, the barrel assembly including a forwardly disposed operating part rotatable about the axis, a key guide post mounted on and extending axially forwardly from the operating part, and a rearwardly disposed stationary part adjoining the operating part at a transverse interfacial plane, the operating part having a planar front face surrounding the guide post and the guide post being adapted to resist application of lock-picking torque, means forming longitudinal bores in the operating and stationary parts and radially outwardly of the post, such bores in respective parts being movable into and out of alignment upon rotation of the operating part, tumblers having separate driver and follower elements carried by the bores in adjoining relation when in aligned bores, and spring means yieldingly urging the tumblers in aligned bores forwardly to positions wherein the interfacial plane is bridged by the follower elements to secure the operating and stationary parts against relative rotation, the driver elements extending forwardly out of the bores in the operating part for engagement of their front ends with bittings on the key; and the key includes a shank having a socket adapted for receiving the guide post therein, bittings on the outer periphery of the shank adapted for endwise engagement with the driver elements, whereby rearward movement of the key moves the tumblers in aligned bores rearwardly to positions wherein the interfacial plane coincides with the joints between the driver and follower elements to free the operating part for rotation, a drive tooth on the outer periphery of the shank and adapted for sidewise engagement alternately with two of the driver elements, for driving the operating part alternately in opposite directions of rotation when the key is turned in such directions, while the bittings serve to free the operating part for rotation, and a torque-applying handle fixed to the shank.

The lock in one preferred form of the invention embodies a key guide post which has a smooth cylindrical outer surface and is fixed to the operating part, the guide post then presenting no torqueing point. In another preferred form of the invention, the lock embodies a key guide post which is mounted on the operating part for rotation relative thereto upon application of torque to the guide post, so that such torque has no affect on the operating part or its operation.

BRIEF DESCRIPTION OF THE DRAWINGS

The attached drawings illustrate preferred embodiments of the lock and key combination of the invention, without limitation thereto. In the drawings, like elements are identified by like reference symbols in each of the views, and.

DESCRIPTION OF THE PREFERRED EMBODIMENTS

Figure 1:
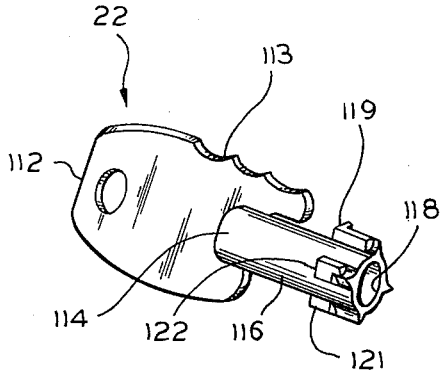
FIG. 1 is a perspective view of a key which cooperates with the lock of FIG. 4, in accordance with the invention.
Figure 4:
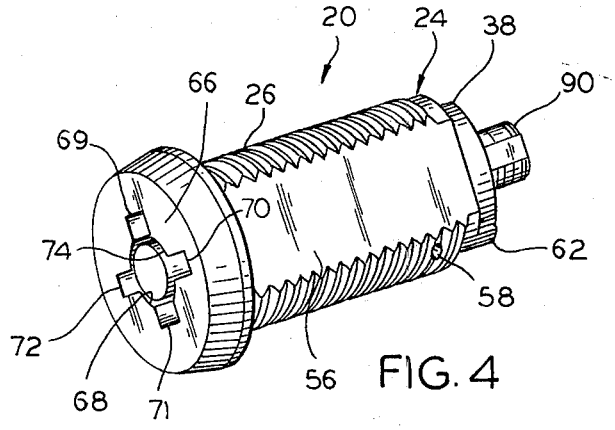
FIG. 4 is a perspective view of one embodiment of a lock according to the invention.

Referring to the drawings, particularly FIGS. 1–5, an axial split-pin tumbler-type lock 20 is employed with a key 22 according to a preferred embodiment of the invention. The illustrative specific embodiment of the lock is identified as a "cam lock," but the invention is not limited thereto, and includes other specific lock types, such as the "switch lock" illustrated in U.S. Pat. No. 3,813,906. They key 22 is of a different type from the "flat" key of the latter patent, being of the "round" or "circular" type, to provide certain advantages, as described hereinafter.

Referring to FIGS. 4–8, the lock 20 includes a tubular lock cylinder 24 having an elongated tubular body 26 and an elongated frusto-conical head 28 on the body at the front end of the lock. A barrel assembly is secured within the cylinder, and it includes a rotatable plug assembly 30 which in the illustrative embodiment is constructed of separate parts, including a post unit 32 and an operating or spindle part 34. The barrel assembly also includes a stationary part in the form of a tubular cylindrical sleeve member 36 in which the plug assembly 30 rotates. The plug assembly rotates about a longitudinal axis 37 which is common to the barrel assembly and its parts.

Figure 6:
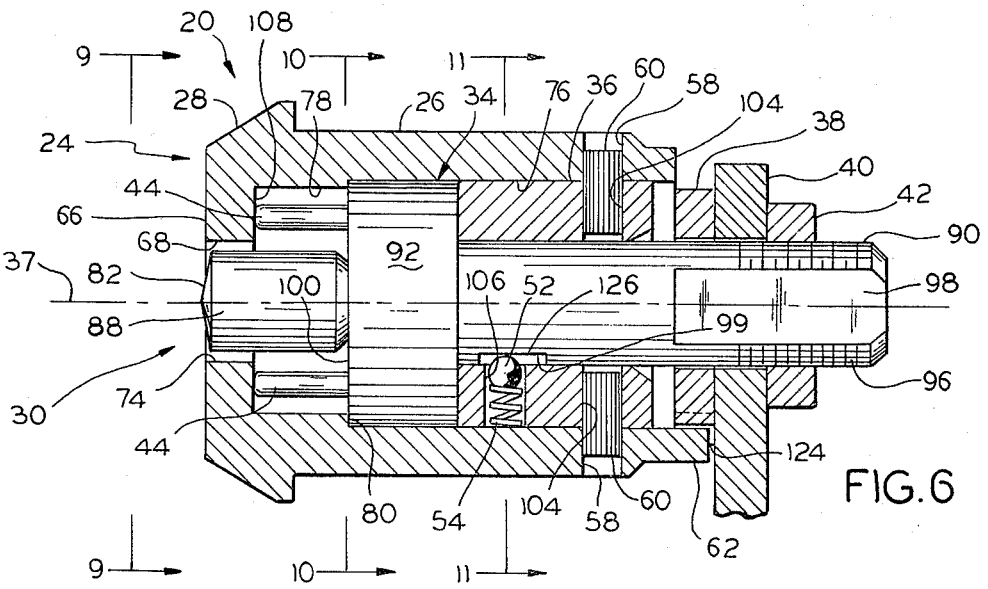
FIG. 6 is an enlarged longitudinal sectional and partly elevational and broken view of the lock, taken substantially on lines 6—6 of FIG. 11.

The lock 20 is operated by turning the plug assembly 30 and thus the operating part 34. In the illustrative embodiment, a stop disc 38 is received on the operating part 34 and cooperates with the cylinder body 26 to limit the rotation of the plug assembly 30, as described hereinafter. Referring to FIG. 6, a locking plate or arm 40, typical of "cam locks" in general, may be mounted on the operating part 34 and secured thereon by a nut 42.

Tumblers are carried by the operating part 34 and the sleeve member 36. The tumblers each include a generally cylindrical driver pin or element 44, carried by the operating part 34, and a generally cylindrical follower or locking pin or element 46 having a stem 48, carried by the sleeve member 36. Coil compression tumbler springs 50 are carried by the sleeve member 36, and one spring is received around the stem 48 of the follower pin 46 of each tumbler. The lock tumblers, under the force of the tumbler springs 50, function to secure the operating part 34 and thus the plug assembly 30 against rotation relative to the sleeve member 36, and are movable by the key 22 to free the plug assembly 30 for rotation relative to the sleeve member 36.

A spherical ball detent 52 is carried by the sleeve member 36. A coil compression detent spring 54 also is carried by the sleeve member 36, and it serves to urge or bias the detent 52 against the operating part 34 of the plug assembly 30, as described in greater detail hereinafter. The detent 52 and cooperating structure perform an important alignment function, and they also provide resistance to plug turning, as subsequently described.

The body 26 of the lock cylinder 24 is threaded for engagement with a mounting nut (not shown), and is provided with a pair of diametrically opposed longitudinal flat surfaces 56, which serve to prevent the lock from turning in its mounting. Two diametrically opposed pin-receiving holes 58 extend through the wall of the body 26, and they receive drive-fit sleeve-mounting pins 60. An arcuate longitudinal extension 62 is integral with the rear end of the cylinder body 26, and the opposite edges 64 thereof constitute stop shoulders which cooperate with the stop disc 38.

The lock 20 is mounted in an opening in a wall, door or other member by inserting the cylinder body 26 through an opening therein, followed by clamping the member between the head 28 and a threaded nut (not shown) engaging the body 26, in a conventional manner. The cylinder head 28 is left protruding, and it is accessible from the outside of the structure.

As seen in FIGS. 4 and 6–9, an annular closure flange 66 is integral with the cylinder head 28, and the flange extends radially inwardly from the cylinder head. The flange defines a central circular opening 68 and slot means extending radially outwardly from the opening. The slot means include four generally rectangular slots 69–72 equiangularly spaced at 90° angles around the opening 68. Three of the slots, numbered 70–72, are the same size, and the remaining slot, numbered 69, is enlarged, extending for a greater distance outwardly from the opening 68. Four arcuate flange portions 74 remain between the several slots, such portions extending to the margin of the central opening 68.

The interior of the lock cylinder 24 includes a cylindrical rearwardly disposed inner wall surface 76 on the body 26, and a circular forwardly disposed ring section 78 of reduced inside diameter with respect to the rear wall surface 76. The ring section 78 is integral with the closure flange 66 and with adjoining portions of the cylinder body 26 and head 28, and the ring section forms a plug-spacing shoulder 80 at its juncture with the rear wall surface 76.

Referring to FIGS. 5–9, the post unit 32 of the plug assembly 30 includes a generally cylindrical key guide post 82 and an integral coaxial generally cylindrical shank 84 of reduced diameter having a slightly enlarged knurl ring 86 therearound. The post 82 has a smooth cylindrical outer surface 88. The operating part 34 constituting the remainder of the plug assembly 30 includes a generally cylindrical lock shaft 90 and an integral cylindrical plug head 92 of greater diameter, and is provided with a cylindrical blind bore 94 (FIGS. 6 and 7) extending axially from the front end of the head 92 into the shaft 90. The rear end of the lock shaft 90 is provided with a screw thread 96 with two diametrically opposed, longitudinally extending flats 98.

Figure 11:
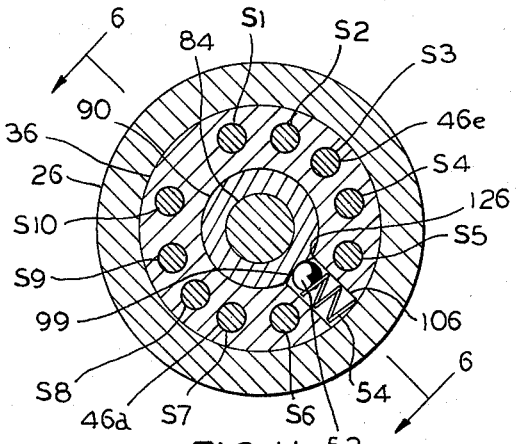

As seen in FIGS. 6 and 11, a detent groove 99 is formed on the surface of the lock shaft 90 of the operating part 34, in adjacent spaced relation to the plug head 92. The groove is elongated in the longitudinal or axial direction and is arcuate in the transverse or circumferential direction of the shaft 90, being laterally inwardly convergent, i.e., converging radially towards the axis 37 of the shaft. The detent groove 99 in the illustrative embodiment is formed with a ball end mill traveling longitudinally on the shaft 90. In an alternative embodiment, not illustrated, a detent groove which is inwardly convergent and of V-shaped cross section may be employed.

The plug assembly 30 is assembled by driving the post unit 32, particularly the shank 84 thereof, into the bore 94 in the operating part 34, with the knurl ring 86 providing a tight drive fit, so that the parts 32 and 34 are rigidly fixed relative to each other in the resulting assembly. An advantage of this construction is that the post unit 32 may be constructed of a very hard metal, to thwart attempts to drill through the lock in this area. However, the plug assembly 30 may be constructed in other ways, with any of the post, shaft and head components separate or integral with some or all of the remaining parts, as most desirable for manufacturing and intended use. In this embodiment, the several parts of the plug assembly 30 are fixed to each other.

Figure 7:
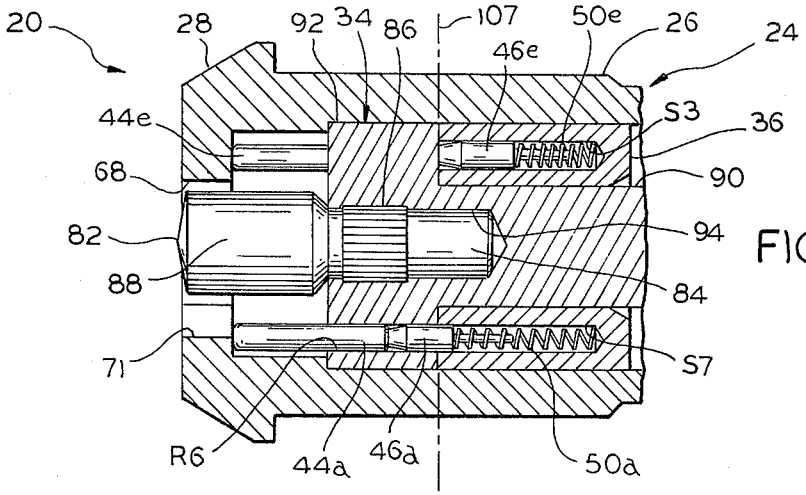
FIG. 7 is a view similar to FIG. 6, but taken substantially on lines 7—7 of FIG. 12.
Figure 8:
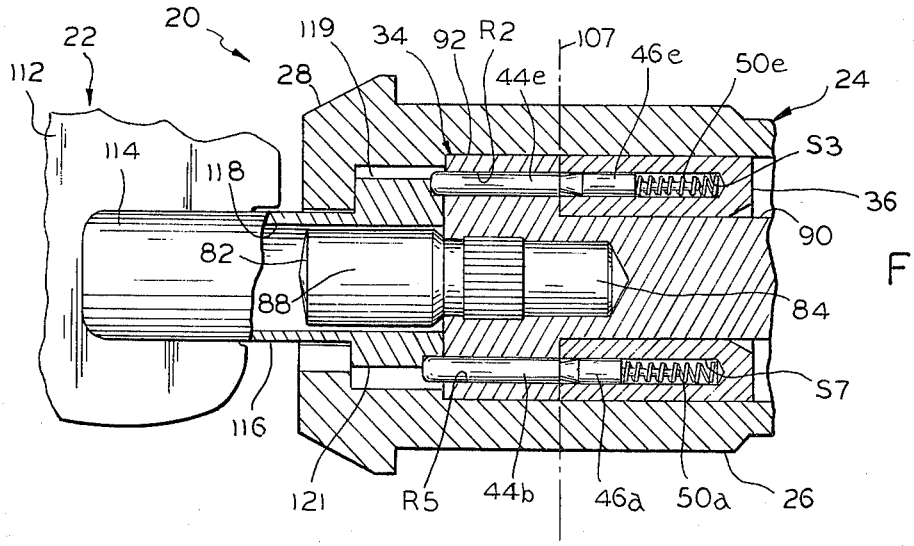
FIG. 8 is a view similar to FIG. 7, but showing the lock with the key inserted therein and a rotatable operating part rotated 30° from the view of FIG. 7, the view of FIG. 8 then being taken substantially on lines 8—8 of FIG. 13.
Figure 9:
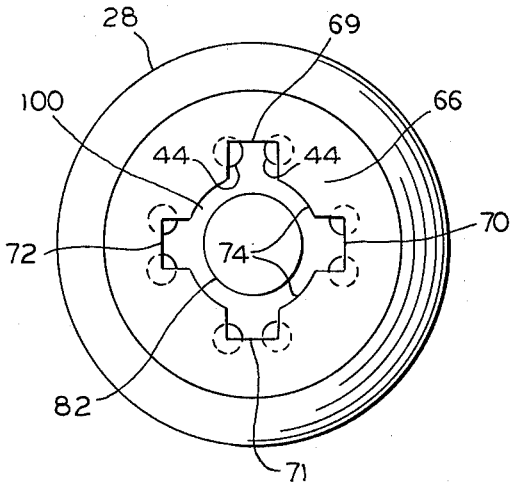
FIG. 9 is a front end elevational view and FIGS. 10 and 11 are cross sectional views of the lock, respectively taken at the planes indicated by the lines 9—9, 10—10 and 11—11 of FIG. 6, in the direction of the arrows, the structure in the several views being oriented in the same manner.
Figure 10:
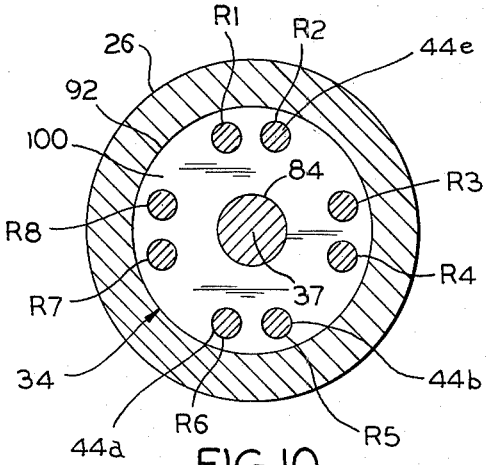

Referring to FIGS. 6 and 10, the head 92 of the rotatable operating part 34 has a planar front face 100 which surrounds the guide post 82 having the smooth cylindrical outer surface 88. By virtue of this structure, the plug assembly 30 is adapted to resist application of lock-picking torque, as described hereinafter. Referring to FIGS. 7, 8 and 10, the plug head 92 is provided with eight longitudinal cylindrical tumbler bores, identified as R1 through R8. The plug bores R1–R8 all have the same diameter and are disposed at equal radii from the longitudinal axis 37. The plug bores R1–R8 are arranged in pairs equiangularly spaced around the axis 37. The bores in each pair are at an angular spacing of 30°, so that the successive pairs are at angular spacings of 60°.

Referring to FIGS. 7, 8 and 11, the sleeve member 36 is provided with ten longitudinal cylindrical tumbler bores, identified as S1 through S10. The sleeve bores S1–S10 are blind bores all having the same diameter and being disposed at the same radial distance from the axis 37 as the plug bores R1–R8. The sleeve bores S1–S10 are arranged in two groups of five bores, numbered S1–S5 and S6–S10, with the bores in each group being angularly spaced 30° from adjacent bores, and with the respective groups being angularly spaced apart 60° at each end of each group.

As seen in FIG. 6, the sleeve member 36 is provided with two diametrically opposed radial pin-receiving holes 104, which are arranged for registry with the pin-receiving holes 58 in the cylinder body 26. The sleeve member 36 also is provided with a radial cylindrical detent socket or bore 106, which is aligned in the longitudinal direction with one of the pin-receiving holes 104.

The width of the detent groove 99 in the lock shaft 90 exceeds the diameter of the ball detent 52, as seen in FIG. 11, to achieve objects described subsequently. The diameter of the detent socket 106 in the sleeve member 36 also is greater than the diameter of the detent 52, to allow freedom of movement of the detent. The diameter of the detent coil spring 54 is greater than the diameter of the detent 52 but smaller than the diameter of the detent bore 106. The spring 54, and particularly the inner coil thereof, is dimensioned so that the detent 52 will nest in the spring and, in general, be centered resiliently in the detent socket 106 thereby. Representative dimensions employed in a preferred embodiment of the invention include a width for the detent groove 99 of 0.093 inch, a diameter for the detent socket 106 of 0.093 inch, a diameter for the spring 54 of 0.084 inch, and a diameter for the ball detent 52 of 0.078 inch. The detent groove 99 at the apex of the transverse arc thereof (FIG. 11) is 0.020 inch deep, and the groove is 0.160 inch long.

Referring to FIGS. 5–8, the lock 20 is assembled with the rotatable operating part 34 having its shaft 90 closely received within the stationary sleeve member 36, and the plug head 92 of the operating part 34 adjoining the sleeve member at a transverse interfacial plane 107, for rotation of the operating part in the sleeve member about the common longitudinal axis 37. A tumbler spring 50 is seated in each of the blind bores S1–S10 in the sleeve member 36, and the stem 48 of one of the follower pins is received in each spring, as illustrated in FIGS. 7 and 8. The follower pins 46 are of various lengths, to resist picking attempts. Driver pins 44, also of different lengths, are received in the bores R1–R8 in the plug head 92. Inasmuch as there are two more sleeve bores than plug bores, there likewise are two more sets of follower pins 46 and tumbler springs 50 than driver pins 44.

Figure 12:
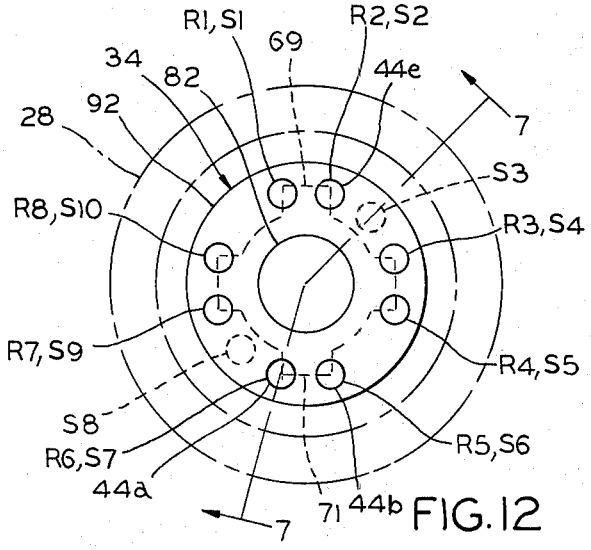
FIGS. 12 and 13 are, respectively, schematic views similar to FIG. 9, but showing the lock cylinder in phantom lines, illustrating the disposition of the lock tumblers and the bores in which the tumbler elements are mounted, in an initial condition of the lock in FIG. 12, and with the operating part of the lock rotated 30° in FIG. 13.

As illustrated in FIG. 12, the operating part 34 and the rearwardly disposed sleeve member 36 are arranged initially so that the four pairs of plug bores R1 and R2, R3 and R4, R5 and R6, and R7 and R8 are aligned respectively with pairs of sleeve bores S1 and S2, S4 and S5, S6 and S7, and S9 and S10. Complete tumblers, each composed of a driver pin 44 and a follower pin 46, and a tumbler spring 50 are carried by the aligned bores with the tumbler elements in adjoining relation, as illustrated in FIG. 7 by the members numbered **44*a*, 46*a* and 50*a*. The follower pins 46 and tumbler springs 50 in the remaining bores S3 and S8 of the sleeve member 36 are behind a solid section of the plug head 92, as illustrated for the members 46*e* and 50*e* in FIG. 7**.

The detent socket 106 and the detent groove 99 are in register, as illustrated in FIGS. 6 and 11, with the detent 52 supported by the inner end of the detent spring 54, and the ball partly in the detent socket 106 and partly in the detent groove 99. When the barrel assembly is mounted in the lock cylinder 24, the detent spring 54 urges or biases the detent 52 towards the lock shaft 90 having the detent groove 99.

With the barrel assembly, the tumblers, and the tumbler springs received in the lock cylinder 24, and the pin-receiving holes 58 and 104 in alignment, as illustrated in FIG. 6, the mounting pins 60 are driven into the holes for securing the parts within the cylinder. At this time, the plug head 92 is in abutting relation to the shoulder 80, thereby spacing the front face 100 of the plug head 92 from the inner surface 108 of the flange 66. The guide post 82 is centered in the flange opening 68 and is spaced from the flange 66, forming an annular space around the post.

As illustrated in FIGS. 6–9, the tumbler bores R1–R8 and S1–S10 are disposed radially outwardly of the flange opening 68. Portions of the aligned pairs of bores, described above, are, however, aligned with respective slots 69–72 in the flange 66, for exposure and access to the tumblers carried by the bores. One quadrant of each bore in the aligned pairs of bores is exposed through three of the slots 70–72, and a larger portion of each bore is exposed through the enlarged slot 69. All of the driver pins 44 are accessible through the flange slots 69–72.

The tumblers under the force of the tumbler springs 50 are urged forwardly in the aligned bores R1–R8 and S1, S2, S4, S5, S6, S7, S9 and S10, respectively, so that the driver pins 44 thereof extend forwardly out of the plug bores R1–R8, until they abut on the inner flange surface 108. The transverse interfacial plane 107 at the adjoining surfaces of the plug head 92 and the sleeve member 36 is bridged by the follower pins 46 in the aligned bores, as illustrated by the follower pin **46*a* in FIG. 7. At this time, the follower pins 46 secure the rotatable operating part 34 and the stationary sleeve member 36 against relative rotation. The driver pins 44** are accessible for engagement with the key 22, as subsequently described.

Figure 2:
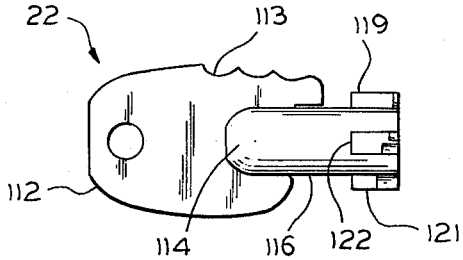
FIG. 2 is a side elevational view of the key.
Figure 3:
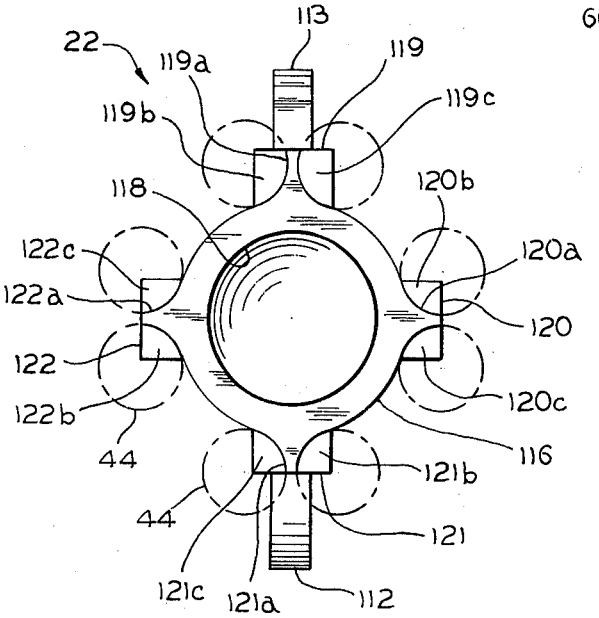
FIG. 3 is an enlarged end elevational view of the key, illustrating the manner in which it engages tumbler driver elements, shown in phantom lines.
Figure 5:
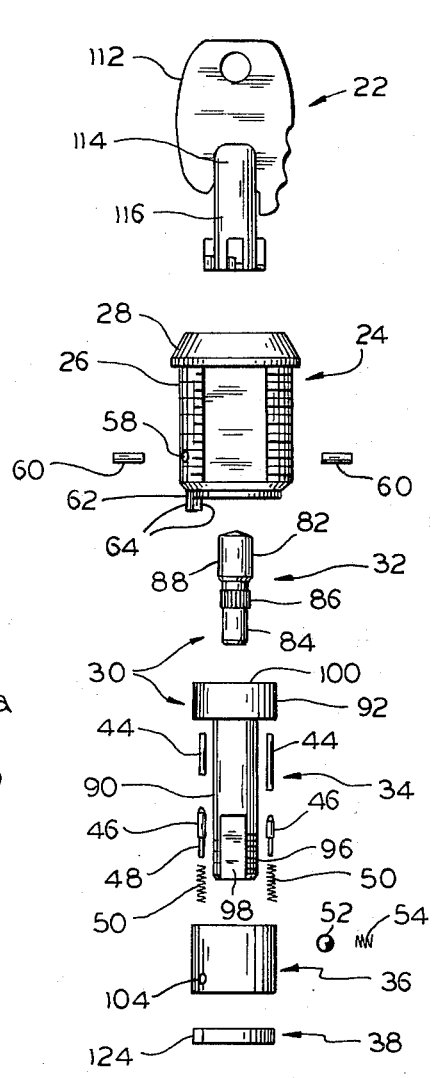
FIG. 5 is an exploded elevational view of the lock and key, drawn to a smaller scale, the lock being illustrated with but part of certain tumbler elements and springs shown.

Referring to FIGS. 1–3, the key 22 includes a wing-type torque-applying or manipulating handle 112 having a scalloped indicating edge 113, and a cylindrical body 114 secured to the handle. A cylindrical shank 116 is integral with the body 114 at the outer end of the key, and the shank has a cylindrical tubular wall defining a cylindrical guide post-receiving socket 118 bounded by a smooth wall surface.

Four tangs 119–122 extend radially outwardly from and are equiangularly spaced around the outer periphery of the shank 116, at 90° angles to each other. The tangs are elongated generally rectangular forms extending longitudinally for equal distances from the mouth of the socket 118. Three of the tangs, numbered 120–122, extend radially outwardly from the longitudinal axis of the shank 116 for equal distances. The remaining shank, aligned with the indicating edge 113 and numbered 119, is enlarged, extending radially for a greater distance, for purposes subsequently described.

Each of the tangs 119–122 is cut away to form a cusp-like drive tooth, numbered 119*a* through 122*a*, respectively, and two bittings adjacent to the tooth, the bittings being numbered 119*b* and 119*c* through 122*b* and 122*c* for the bittings on the respective tangs. The bittings on each tang are provided on opposite sides of the tooth thereof, for engagement with the front ends of respective driver pins 44. As seen in FIG. 3, the bittings 120*b,c* to 122*b,c* on the smaller tangs 120–122 when viewed in plan are slightly smaller in size than the quadrant of a circle illustrated thereon in phantom lines. The circles correspond to the circumference of the several driver pins 44, as they appear when engaged by the key. The drive teeth 120*a* –122*a* extend radially outwardly from the key shank 116 to the outer surface of the tangs 120–122, so that they extend about to the center of the driver elements 44 when engaged by the adjacent bittings, as represented in FIG. 3. In the case of the larger tang 119, the bittings 119*b* and 119*c* cover a larger area than a quadrant of the circle defining a driver pin 44, and the drive tooth 119*a* extends radially beyond the center of the driver pins 44 engaged by the adjacent bittings 119*b* and 119*c*. The bittings 119*b,c* to 122*b,c* are formed in their tangs for engagement with the front ends of the driver pins 44 at varying distances from the mouth of the socket 118 in the key shank 116, to cooperate with driver pins 44 of correspondingly varying lengths. The drive teeth 119*a* to 122*a* are adapted for sidewise engagement alternately with the driver pins 44 engaging the bittings adjacent the respective teeth.

The key 22 is insertable in the lock 20 for the purpose of rotating the operating part 34 and thus the locking plate 40 between locking and unlocking rotational positions thereof. When the key is to be inserted, the indicating edge 113 is aligned with the enlarged key slot 69, thereby aligning the enlarged tang 119 with the enlarged slot. The wall of the key shank 116 is insertable in the space between the closure flange 66 and the guide post 82, substantially filling the space. The socket 118 in the shank 116 is adapted for receiving the guide post 82 therein, and the shank bottoms on the face 100 of the plug head 92. The tangs 119–122 are received closely within and pass through respective slots 69–72 in the flange 66, being insertable internally of the lock cylinder 24 and beyond the flange 66. The tangs turn behind and are retained in the lock by the flange 66 as the key 22 is turned.

The bittings 119*b,c* to 122*b,c* engage the front ends of successive driver pins 44 around the lock. When the key is inserted so as to bottom on the plug head 92, the several driver pins 44 are moved rearwardly against the bias of the tumbler springs 50 to positions wherein the interfacial plane 107 coincides with the joints between the driver and follower pins 44 and 46, as illustrated in FIG. 8, to free the operating part 34 for rotation. The tumbler bores R1–R8 and S1–S10 are spaced apart and the driver pins 44 in each pair of plug bores R1 and R2, R3 and R4, R5 and R6, and R7 and R8 are adapted for receiving the drive teeth 119*a*–122*a* in sidewise engagement alternately with the driver pins in each pair, for driving the rotatable plug assembly 30 alternately in opposite directions of rotation when the key is turned in such directions, while the bittings 119*b,c* to 122*b,c* serve to hold the tumblers in their positions freeing the plug assembly 30 for rotation.

In the prior axial split-pin tumbler-type locks, the key engages a rotatable plug assembly or the like in some manner for the purpose of rotating the assembly. In the above-identified U.S. Pat. No. 3,813,906, a post 104 is provided with a keyway 106 in which a key shank 124 is inserted. The key 22 serves to rotate the plug member 28 in the patent by engagement of the key shank 124 with the post 104. In U.S. Pat. No. 3,267,706, the key 31 rotates the rotatable part 16 by engagement of a fin 30*a* alternately with edges 110 and 112 on the rotatable part 16. A like structure is employed in U.S. Pat. No. 3,320,783. The prior structures in the foregoing and other ways provide torqueing points on the rotatable operating parts, which may be engaged by a pick mechanism to apply torque to the operating part while the tumblers are probed. An important feature of the present invention is the above-described structure of a planar front face 100 on the plug head 92 and a guide post 82 having a smooth cylindrical outer surface 88, which provide no groove, slot, reaction edge or other distinct torqueing point on the rotatable plug assembly 30 for engagement with a picking tool. This leaves only the driver pins 44 extending for possible application of torque to the operating part 34, but the driver pins cannot be both torqued and probed successfully at the same time.

An important cooperating feature of the invention is the drive structure of the drive teeth 119*a* –122*a* engaging the driver pins 44. This structure enables the plug assembly 30 to be constructed free of torque points, since there no longer is any need to provide a drive point thereon for engagement with the key. It is preferred for reliable trouble-free operation that the drive teeth 119*a*–122*a* extend radially outwardly from the key shank 116 at least about to the center of the driver elements 44 engaged by their adjacent bittings 119*b,c* to 122*b,c*, so that the teeth engage the driver pins well and in line with their centers or axes, and without slippage and/or jamming the key in the lock. In this connection, while a similar structure of bittings 130–133 and tooth-like portions between adjacent bittings 130, 131 and 132, 133 on tangs 126 and 128 has been employed in the structure disclosed in U.S. Pat. No. 3,813,906, the plug member 28 of the patent was driven by engagement of the key shank 124 with the post 104 of the patent, rather than by engagement with the tooth-like portions on the tangs 126 and 128. Any engagement of such tooth-like portions with the driver pins 32 of the patent was only incidental and secondary to the driving force imparted by the key to the post 104.

The lock 20 in the illustrative embodiment is adapted for 90° rotation of the plug assembly 30 and the operating part 34 thereof between the locking and unlocking positions. For this purpose, the stop disc 38, which is rotatable with the shaft 90, is provided with a projection 124 (FIGS. 5 and 6) which engages the stop shoulders 64 on the lock cylinder extension 62 alternately upon 90° rotation in opposite directions. The locking plate 40, also rotatable with the shaft 90, rotates 90°, according to the limits established by the stop disc 38 and the extension 62, between a locking position wherein the plate 40 engages a suitable keeper, latching member, or the like, and an unlocking position of disengagement therewith.

As described above, the key tangs 119–122 are inserted through the key slots 69–72 and behind the closure flange 66 for operation of the lock. The tangs 119–122 extend longitudinally from the mouth of the socket 118 for distances equal to the length or depth of the internal ring section 78 on the lock cylinder 24. Consequently, the outer edges of the tangs substantially abut on the inner flange surface 108, as illustrated in FIG. 8. This construction serves to hold the driver pins 44 with their inner ends at the interfacial plane 107 as the key is turned, and to maintain the key in the lock during turning. The key can be removed from the lock in one position only, that is, in the position in which the enlarged tang 119 registers with the enlarged slot 69, providing what is known as a "one-way key pull."

Figure 13:
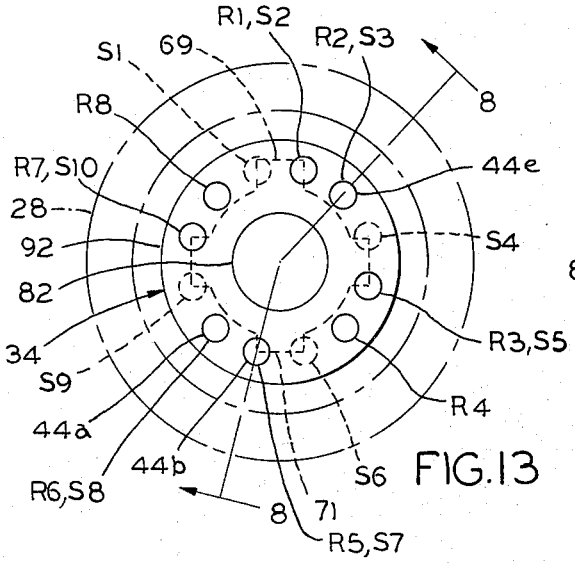

Referring to FIGS. 10 and 11 for the locations of the respective bores in the barrel assembly, the schematic views of FIGS. 12 and 13, respectively, show in full lines the positions of the plug bores R1–R8 and the driver elements 44 therein, initially and after 30° rotation of the operating part 34 in the clockwise direction. The sleeve bores S1–S10 appear in broken lines, when not obscured by the representations of the plug bores and driver elements. Initially, the aligned bores in respective pairs are R1, S1 and R2, S2; R3, S4 and R4, S5; R5, S6 and R6, S7; and R7, S9 and R8, S10, as illustrated in FIG. 12. FIG. 7 illustrates one of the tumblers in the aligned bores, composed of a driver pin 44*a* in a plug bore R6, and an adjoining follower pin 46*a* in a sleeve bore S7. Insertion of the key 22 moves the eight tumblers in these bores rearwardly to free the operating part 34 for rotation, whereupon rotation of the key through an angle of 90° will place the lock in a condition once more appearing as illustrated in FIG. 12, but with different plug bores R1–R8 matched with the sleeve bores S1, S2, S4, S5, S6, S7, S9, and S10. Likewise, different driver pins 44 in the plug bores then are matched with the follower pins 46 in the sleeve bores. In an alternative embodiment, described hereinafter, removal of a modified key at this point would leave the tumblers in a condition such as illustrated in FIG. 7, securing the operating part 34 against rotation.

In the course of rotating the operating part 34 between locking and unlocking positions, the respective plug and sleeve bores and the tumbler elements therein go through two additional positions of registry of different bores, at 30° and 60° of rotation. The condition at 30° of rotation is illustrated in FIG. 13, wherein it is indicated that plug bores R1, R2, R3, R5, R6, and R7 are aligned with sleeve bores S2, S3, S5, S7, S8 and S10, respectively. FIG. 8 illustrates two of the tumblers in the aligned bores, one composed of a driver pin 44*e* and a follower pin 46*e*, and one composed of a driver pin 44*b* and a follower pin 46*a*. Plug bore R4 and R8 no longer are aligned with sleeve bores, inasmuch as there are no sleeve bores at such locations. Sleeve bores S1, S4, S6, and S9 no longer are aligned with plug bores, inasmuch as there are no plug bores at such locations.

Sleeve bores S3 and S8, previously not aligned with plug bores, are aligned with respective plug bores R2 and R6. The change in alignment of sleeve bore S3 is illustrated by FIGS. 7 and 8. Inasmuch as these bores and the tumbler elements therein are completely concealed beneath two of the arcuate flange portions 74, a pick-resistance function is provided, like the corresponding function disclosed in U.S. Pat. No. 3,813,906. Thus, if it were possible to pick the lock in the initial condition of FIG. 12 with a tool which could not follow the driver pins underneath the flange portions 74, the operating part 34 and the sleeve member 36 would again become secured against relative rotation by the tumblers in the aligned bores R2, S3 and R6, S8 upon rotation of the operating part 34 for 30°, to thwart the picking attempt. Access to the tumblers beneath the flange portions 74, for a further picking attempt, is very difficult to obtain. A similar condition would obtain upon 60° of rotation, when the plug bores R1 and R5 would be aligned with the respective sleeve bores S3 and S8 under flange portions 74.

In the illustrative embodiment, the operating part 34 is rotated 90° from its initial position illustrated in FIG. 6, to a second position, which may serve, for example, to unlock a cabinet or the like. Subsequently, the operating part 34 is rotated 90° in the opposite direction, at which time the key 22 is removed and the lock 20 and structure locked thereby are restored to their initial conditions. There is a tendency for personnel to pull out the key 22 rapidly, and it is possible at times for the key to be removed before the plug bores R1–R8 have been restored completely into positions of alignment with the sleeve bores S1, S2, S4, S5, S6, S7, S9, and S10, respectively. Should this happen, the follower pins 46 may remain engaged with or caught on the edges of the plug bores, on the inner surface of the plug head 92. The lock then would be left in a condition in which the lengths of the driver pins 44 could be determined, for picking purposes, and, also, the operating part 34 could be rotated for 30° without a proper key.

The spring-pressed ball detent-and-groove connection, represented by the detent 52, the detent spring 54, the detent groove 99, and the detent socket 106, performs an important function in assuring that the lock 20 is secured when the key 22 is removed, even though the key be removed prematurely. With the width of the detent groove 99 exceeding the diameter of the ball detent 52, as illustrated in FIG. 11, the detent effectively engages one side edge 126 of the detent groove in advance of proper alignment of the plug bores R1–R8 and the sleeve bores S1–S10. The detent 52 under the force of its spring 54 then tends to move into the detent groove 99, providing a camming action which rotates the operating part 34 until the detent is seated at the deepest part or apex of the convergent groove 99, as seen in FIGS. 6 and 11, and the respective bores are properly aligned, as illustrated in FIGS. 7 and 12. The structure performs an additional function when the lock is in its locking condition, in providing a "false" resistance to turning of the plug assembly 30, not related to the disposition of a tumbler, thereby increasing the difficulty of picking the lock.

Figure 14:
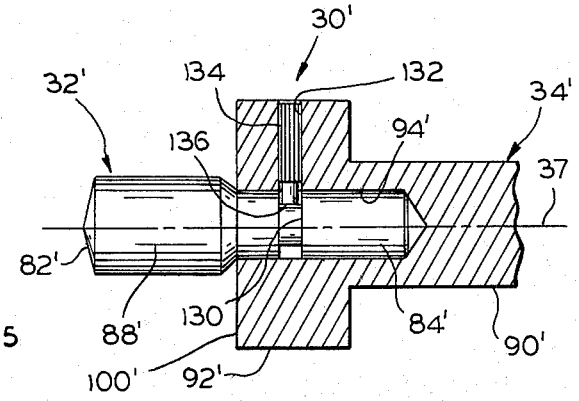
FIG. 14 is a fragmentary sectional and elevational view of another embodiment of a rotatable plug assembly employed in the lock.

FIG. 14 illustrates a second rotatable plug assembly 30', which may be employed in the new lock, in place of the above-described first plug assembly 30, and which also is adapted to resist application of lock-picking torque thereto. Prime numbers have been applied to the components of the second plug assembly 30', to indicate similarity to components of the first plug assembly 30 that are identified by the same reference numbers. The two plug assemblies 30 and 30' may be used interchangeably in a lock in which the remainder of the structure is constructed and functions as described above for the illustrative lock 20, and they have the same longitudinal axis 37 of rotation therein. The same key 22 may be employed with both plug assemblies 30 and 30'.

The second plug assembly 30' includes a post unit 32' and an operating or spindle part 34'. The post unit 32' includes a generally cylindrical key guide post 82' having a smooth cylindrical outer surface 88', and an integral coaxial generally cylindrical shank 84' of reduced diameter. The guide post 82' is identical to the guide post 82 shown in the preceding views of the first plug assembly 30. An annular pin-receiving groove 130 of rectangular cross section is formed in the shank 84' circumferentially therearound and intermediate its ends.

The operating part 34' includes a generally cylindrical lock shaft 90' and an integral cylindrical plug head 92' of greater diameter, and is provided with a cylindrical blind bore 94' extending axially from a planar front face 100' on the head 92' into the shaft 90'. A radial pin-receiving hole 132 is provided in the plug head 92', the hole extending between longitudinal tumbler bores, not seen in FIG. 14, which are in all respects the same as the bores R1–R8 shown in the preceding views of the first plug assembly 30. Except for the addition of the hole 132, the operating part 34' is identical to the operating part 34 of the first plug assembly 30.

The shank 84' of the post unit 32' is closely received in the operating part bore 94' for rotation therein about the axis 37. The hole 132 in the plug head 92' then is in alignment or registers with the shank groove 130. A postmounting pin 134 is inserted in the hole 132, being force-fitted therein, and its inner end 136 extends freely into the shank groove 130. The pin 134 serves to retain the post unit 32' rotatably in the operating part 34'.

The second plug assembly 30' as a whole is rotatably mounted in the lock cylinder 24, in like manner to the first plug assembly 30. The lock shaft 90' is rotatably received in the sleeve member 36, as illustrated for the lock shaft 90 in preceding views. The plug head 92' of the operating part 34' adjoins the sleeve member 36 at the above-described interfacial plane 107.

As in the case of the first plug assembly 30, the second plug assembly 30' provides no distinct point at which torque effective on the operating part 34' may be applied. The front face 100' on the plug head 92' is planar and therefore free of any torqueing point. The guide post 82' will rotate relative to the operating part 34' upon application of torque to the guide post, preventing transfer of torque to the operating part 34' from the guide post. The construction of the second plug assembly 30' thus safeguards against the possibility that torque may be applied effectively to a guide post fixed to the operating part despite the absence of a distinct torqueing point on the guide post.

Another feature of the invention resides in the structure of the key 22, which is not easily duplicated. A duplicate key cannot be made readily from a plain tube, but either special tooling or considerable effort is required to make such a key, having a circular-type shank, tangs extending radially therefrom, and teeth and bitting cuts in the tangs extending longitudinally in the direction of the axis of the key.

The lock 20, incorporating either the first plug assembly 30 or substituting the second plug assembly 30', and the key 22 may be constructed for a "two-way key pull," rather than the illustrative "one-way key pull." In the alternative construction, all of the tangs 119–122 may be made in the same size, and, likewise, the key slots 69–72 have the same dimensions. The key 22 then may be inserted and removed both in the initial condition of the lock and when the plug assembly 30 or 30' is rotated 90°. With the key 22 removed, the operating part 34 or 34' is secured against rotation in both positions, by the lock tumblers, the follower pins 46 of which bridge the interfacial plane 107.

The preferred illustrative constructions of the lock and key, wherein four pairs of tumblers are employed in a symmetrical arrangement around the axis 37, balances the application of forces upon insertion and operation of the key. The use of eight tumblers, requiring eight key bittings, also provides a high degree of security against picking and provides for numerous key changes. If desired, but with corresponding sacrifice of such advantages, the number of tumblers may be reduced, down to two, and/or the tumbler spacing may be altered. Thus, for example, the aligned plug and sleeve bores carrying tumbler elements 44 and 46 may be reduced to those identified as R1, S1 and R2, S2. In such case, it is preferred to retain the additional sleeve bore S3 and its tumbler element **46*e* and spring 50*e***, to provide the additional resistance to picking described above.

While the illustrative lock structures are limited to rotation of the operating part 34 or 34' between operating positions at an angle of 90° to each other, by virtue of the extension 62 on the cylinder body 26 and its cooperation with the stop disc 38, the extent of the rotation during operation may be varied with suitable adjustments. For example, the range of operation may be extended to 180°, or to 360°, which necessitates alteration of such stop means. Where turning beyond 360° is acceptable, the stop means may be eliminated.

While preferred embodiments of the invention have been illustrated and described, and reference has been made to various changes and modifications which may be made in the embodiments, it will be apparent that further changes and modifications may be made therein within the spirit and scope of the invention. It is intended that all such changes and modifications be included within the scope of the appended claims.

Having thus described the invention, what I claim as new and desire to secure by Letters Patent is:

1. In combination, an axial split-pin tumbler-type lock and a key therefor, said lock comprising:

a lock cylinder, a barrel assembly secured within said cylinder and having a longitudinal axis extending between front and rear ends thereof, said barrel assembly including a forwardly disposed operating part rotatable about said axis, a key guide post mounted on and extending axially forwardly from the operating part, and a rearwardly disposed stationary part adjoining the operating part at a transverse interfacial plane, said operating part having a planar front face surrounding said guide post and said guide post being adapted to resist application of lock-picking torque, means forming longitudinal bores in said operating and stationary parts and disposed radially outwardly of said post at equal radii from said axis, said bores in respective parts being movable into and out of alignment upon rotation of said operating part, means providing a spring-pressed ball detent-and-groove connection between said operating and stationary parts, the width of the groove exceeding the diameter of the detent in said connection thereby to provide a camming action for bringing said parts into alignment of said bores therein, tumblers having separate driver and follower elements carried by said bores in adjoining relation when in aligned bores, and spring means yieldingly urging said tumblers in aligned bores forwardly to positions wherein said interfacial plane is bridged by said follower elements to secure the operating and stationary parts against relative rotation, said driver elements extending forwardly out of said bores in the operating part for engagement of their front ends with bittings on said key;

and said key comprising:

a shank having a socket adapted for receiving said guide post therein, bittings on the outer periphery of said shank adapted for endwise engagement with said driver elements, whereby rearward movement of the key moves said tumblers in aligned bores rearwardly to positions wherein said interfacial plane coincides with the joints between said driver and follower elements to free said operating part for rotation, a drive tooth on the outer periphery of said shank and adapted for sidewise engagement alternately with two of said driver elements, for driving said operating part alternately in opposite directions of rotation when the key is turned in such directions, while said bittings serve to free said operating part for rotation, and a torque-applying handle fixed on said shank.

2. A combination as defined in claim 1 and wherein said guide post has a smooth cylindrical outer surface and is fixed to said operating part, and said shank socket is cylindrically shaped.

3. A combination as defined in claim 1 and wherein said guide post is mounted on said operating part for rotation relative thereto upon application of torque to the guide post.

4. In combination, an axial split-pin tumbler-type lock and a key therefor, said lock comprising:

a lock cylinder including an annular flange on an end thereof extending radially inwardly and defining a central circular opening into the cylinder and a plurality of slots extending radially outwardly from and equiangularly spaced around the opening, a barrel assembly secured within said cylinder and having a longitudinal axis extending between front and rear ends thereof, said barrel assembly including a forwardly disposed operating part rotatable about said axis, a key guide post mounted on and extending axially forwardly from the operating part, and a rearwardly disposed stationary part adjoining the operating part at a transverse interfacial plane, said operating part having a planar front face surrounding said guide post and said guide post being adapted to resist application of lock-picking torque, said guide post extending into said opening and being spaced from said flange, means forming pairs of longitudinal cylindrical bores in each of said operating and stationary parts and equiangularly spaced around said axis, said bores being disposed radially outwardly of said flange opening at equal radii from said axis, said pairs of bores in respective parts being movable into and out of alignment upon rotation of said operating part and portions of the aligned pairs of bores being aligned with respective ones of said slots, tumblers having separate cylindrical driver and follower elements carried by said bores in adjoining relation and accessible through said slots when in aligned bores, and spring means yieldingly urging said tumblers in aligned bores forwardly to positions wherein said interfacial plane is bridged by said follower elements to secure the operating and stationary parts against relative rotation, said driver elements extending forwardly out of said bores in the operating part for engagement of their front ends with bittings on said key;

and said key comprising:

a shank having a cylindrical tubular wall insertable in the space between said flange and said guide post and defining a socket adapted for receiving said guide post therein, a plurality of tangs extending radially outwardly from and equiangularly spaced around the outer periphery of said shank, said tangs extending for equal longitudinal distances from the mouth of said socket, said tangs each being formed to provide a cusp-like drive tooth and two adjacent bittings on opposite sides of the drive tooth for engagement of the tooth and bittings of each tang with said tumbler driver elements extending from one of said pairs of bores in the operating part, said tangs being insertable through respective ones of said slots and internally of said cylinder beyond said flange, and said tangs turning behind and being retained in the lock by said flange as said key is turned, said bittings each being adapted for endwise engagement with one of said driver elements, whereby rearward movement of the key moves said tumblers in aligned bores rearwardly to positions wherein said interfacial plane coincides with the joints between said driver and follower elements to free said operating part for rotation, said drive teeth each extending radially outwardly from said shank at least about to the center of the driver elements engaged by the adjacent bittings and being adapted for sidewise engagement alternately with the latter driver elements, for driving the operating part alternately in opposite directions of rotation when the key is turned in such directions, while said bittings serve to free said operating part for rotation, and a torque-applying handle fixed to said shank.

5. A combination as defined in claim 4 and including means providing a detent socket in one of said operating and stationary parts and a laterally convergent detent groove in the other of said parts and adapted for registering with the socket when said bores in said operating and stationary parts are aligned, a ball detent in said socket, and spring means in said socket and urging said detent towards the part having said groove, the width of said groove exceeding the diameter of said detent, thereby to provide a camming action for bringing said parts into alignment of said bores therein.

6. An axial split-pin tumbler-type lock comprising:

a lock cylinder, a barrel assembly secured within said cylinder and having a longitudinal axis extending between front and rear ends thereof, said barrel assembly including a forwardly disposed operating part rotatable about said axis, a key guide post mounted on and extending axially forwardly from the operating part, and a rearwardly disposed stationary part adjoining the operating part at a transverse interfacial plane, said operating part having a planar front face surrounding said guide post and said guide post being adapted to resist application of lock-picking torque, means forming longitudinal bores in said operating and stationary parts and disposed radially outwardly of said post at equal radii from said axis, said bores in respective parts being movable into and out of alignment upon rotation of said operating part, means providing a spring-pressed ball detent-and-groove connection between said operating and stationary parts, the width of the groove exceeding the diameter of the detent in said connection thereby to provide a camming action for bringing said parts into alignment of said bores therein, tumblers having separate driver and follower elements carried by said bores in adjoining relation when in aligned bores, and spring means yieldingly urging said tumblers in aligned bores forwardly to positions wherein said interfacial plane is bridged by said follower elements to secure the operating and stationary parts against relative rotation, said driver elements extending forwardly out of said bores in the operating part for engagement of their front ends with bittings on a key, whereby rearward movement of the key moves said tumblers in aligned bores rearwardly to positions wherein said interfacial plane coincides with the joints between said driver and follower elements to free said operating part for rotation, two of said driver elements being adapted for sidewise engagement alternately with a drive tooth on the outer periphery of a key shank which is seated on said post, for driving said operating part alternately in opposite directions of rotation when the key is turned in such directions, while bittings on the key shank serve to free said operating part for rotation.

7. A lock as defined in claim 6 and wherein said guide post has a smooth cylindrical outer surface and is fixed to said operating part.

8. A lock as defined in claim 6 and wherein said guide post is mounted on said operating part for rotation relative thereto upon application of torque to the guide post.

9. An axial split-pin tumbler-type lock comprising:

a lock cylinder including an annular flange on an end thereof extending radially inwardly and defining a central circular opening into the cylinder and a plurality of slots extending radially outwardly from and equiangularly spaced around the opening, a barrel assembly secured within said cylinder and having a longitudinal axis extending between front and rear ends thereof, said barrel assembly including a forwardly disposed operating part rotatable about said axis, a key guide post mounted on and extending axially forwardly from the operating part, and a rearwardly disposed stationary part adjoining the operating part at a transverse interfacial plane, said operating part having a planar front face surrounding said guide post and said guide post being adapted to resist application of lock-picking torque, said guide post extending into said opening and being spaced from said flange, means forming pairs of longitudinal cylindrical bores in each of said operating and stationary parts and equiangularly spaced around said axis, said bores being disposed radially outwardly of said flange opening at equal radii from said axis, said pairs of bores in respective parts being movable into and out of alignment upon rotation of said operating part and portions of the aligned pairs of bores being aligned with respective ones of said slots, means providing a detent socket in one of said operating and stationary parts and a laterally convergent detent groove in the other of said parts and adapted for registering with the socket when said bores in said operating and stationary parts are aligned, a ball detent in said socket, and spring means in said socket and urging said detent towards the part having said groove, the width of said groove exceeding the diameter of said detent, thereby to provide a camming action for bringing said parts into alignment of said bores therein, tumblers having separate cylindrical driver and follower elements carried by said bores in adjoining relation and accessible through said slots when in aligned bores, and spring means yieldingly urging said tumblers in aligned bores forwardly to positions wherein said interfacial plane is bridged by said follower elements to secure the operating and stationary parts against relative rotation, said driver elements extending forwardly out of said bores in the operating part for engagement of their front ends with bittings on a key, whereby rearward movement of the key moves said tumblers in aligned bores rearwardly to positions wherein said interfacial plane coincides with the joints between said driver and follower elements to free said operating part for rotation, the driver elements in each pair of bores in the rotatable part being adapted for sidewise engagement alternately with a cusp-like drive tooth on a tang on the outer periphery of a key shank which is seated on said post, for driving said operating part alternately in opposite directions of rotation when the key is turned in such directions, while two bittings on the tang and adjacent to said drive tooth on opposite sides thereof serve to free said operating part for rotation, said cylinder receiving such key tanks inserted through respective ones of said slots and internally of the cylinder beyond said flange, for turning the tangs behind said flange and retaining them in the lock thereby as the key is turned.

10. A key for an axial split-pin tumbler-type lock comprising:

a shank having a cylindrical tubular wall defining a cylindrical socket adapted for receiving therein a key guide post of such a lock having a smooth cylindrical outer surface, a plurality of tangs extending radially outwardly from and equiangularly spaced around the outer periphery of said shank, said tangs extending for equal longitudinal distances from the mouth of said socket, said tangs each being formed to provide a cusp-like drive tooth and two adjacent bittings on opposite sides of the drive tooth for engagement of the tooth and bittings of each tang with two cylindrical tumbler driver elements extending forwardly out of bores in a rotatable operating part of such a lock, said bittings each being adapted for engagement with the front end of one of said driver elements, whereby rearward movement of the key moves the lock tumblers rearwardly to free the operating lock part for rotation, said drive teeth each extending radially outwardly from said shank at least about to the center of the driver elements engaged by the adjacent bittings and being adapted for sidewise engagement alternately with the latter driver elements, for driving the lock operating part alternately in opposite directions of rotation when the key is turned in such directions, while said bittings serve to free the operating part for rotation, and a torque-applying handle fixed to said shank.

11. In combination, an axial split-pin tumbler-type lock and a key therefor, said lock comprising:

a lock cylinder including an annular flange on an end thereof extending radially inwardly and defining a central circular opening into the cylinder and a slot extending radially outwardly from the opening, a barrel assembly secured within said cylinder and having a longitudinal axis extending between front and rear ends thereof, said barrel assembly including a forwardly disposed operating part rotatable about said axis, a key guide post mounted on and extending axially forwardly from the operating part, and a rearwardly disposed stationary part adjoining the operating part at a transverse interfacial plane, said operating part having a planar front face surrounding said guide post and said guide post being adapted to resist application of lock-picking torque, said guide post extending into said opening and being spaced from said flange, means forming a pair of longitudinal bores in each of said operating and stationary parts and disposed radially outwardly of said flange opening at equal radii from said axis, said pairs of bores in respective parts being movable into and out of alignment upon rotation of said operating part and portions of the aligned bores being aligned with said slot, tumblers having separate driver and follower elements carried by said bores in adjoining relation and accessible through said slot when in aligned bores, and spring means yieldingly urging said tumblers in aligned bores forwardly to positions wherein said interfacial plane is bridged by said follower elements to secure the operating and stationary parts against relative rotation, said driver elements extending forwardly out of said bores in the operating part for engagement of their front ends with bittings on said key;

and said key comprising:

a shank having a cylindrical tubular wall insertable in the space between said flange and said guide post and defining a socket adapted for receiving said guide post therein, a tang extending radially outwardly from the outer periphery of said shank, said tang being formed to provide a cusp-like drive tooth and two adjacent bittings on opposite sides of the drive tooth for engagement with said tumbler driver elements, said tang being insertable through said slot and internally of said cylinder beyond said flange, and said tang turning behind and being retained in the lock by said flange as said key is turned, said bittings each being adapted for endwise engagement with one of said driver elements, whereby rearward movement of the key moves said tumblers in aligned bores rearwardly to positions wherein said interfacial plane coincides with the joints between said driver and follower elements to free said operating part for rotation, said drive tooth extending radially outwardly from said shank and being adapted for sidewise engagement alternately with said driver elements, for driving the operating part alternately in opposite directions of rotation when the key is turned in such directions, while said bittings serve to free said operating part for rotation, and a torque-applying handle fixed to said shank.

12. A combination as defined in claim 11 and including means providing a spring-pressed ball detent-and-groove connection between said operating and stationary parts, the width of the groove exceeding the diameter of the detent in said connection thereby to provide a camming action for bringing said parts into alignment of said bores therein.

13. A key for an axial split-pin tumbler-type lock comprising:

a shank having a cylindrical tubular wall defining a cylindrical socket adapted for receiving therein a key guide post of such a lock having a smooth cylindrical outer surface, a tang extending radially outwardly from the outer periphery of said shank, said tang being formed to provide a cusp-like drive tooth and two adjacent bittings on opposite sides of the drive tooth for engagement with two cylindrical tubular driver elements extending forwardly out of bores in a rotatable operating part of such a lock, said bittings each being adapted for engagement with the front end of one of said driver elements, whereby rearward movement of the key moves the lock tumblers rearwardly to free the operating lock part for rotation, said drive tooth extending radially outwardly from said shank and being adapted for sidewise engagement alternately with said driver elements, for driving the lock operating part alternately in opposite directions of rotation when the key is turned in such directions, while said bittings serve to free the operating part for rotation, and a torque-applying handle fixed to said shank.

14. A key as defined in claim 13 and wherein said drive tooth extends radially outwardly from said shank at least about to the center of cylindrical tumbler driver elements to be engaged thereby.

* * * * *